US007905573B2

(12) United States Patent
Takemoto et al.

(10) Patent No.: US 7,905,573 B2
(45) Date of Patent: Mar. 15, 2011

(54) LIQUID EJECTION HEAD WITH NOZZLE PLATE DEFORMED BY HEAT AND IMAGE FORMING APPARATUS INCLUDING THE LIQUID ELECTION HEAD

(75) Inventors: Takeshi Takemoto, Yamato (JP); Yasuhisa Kato, Hiratsuka (JP); Kazuyoshi Matsumoto, Tokyo (JP); Minori Ichimura, Tokyo (JP); Manabu Izumikawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 333 days.

(21) Appl. No.: 12/140,505

(22) Filed: Jun. 17, 2008

(65) Prior Publication Data

US 2008/0316279 A1 Dec. 25, 2008

(30) Foreign Application Priority Data

Jun. 19, 2007 (JP) ..... 2007-160858
Apr. 15, 2008 (JP) ..... 2008-105277

(51) Int. Cl.
*B41J 2/04* (2006.01)

(52) U.S. Cl. ..... 347/54; 347/65; 347/68

(58) Field of Classification Search ..... 347/20, 347/44, 47, 54, 56, 61–65, 67–68, 70–71, 347/92–94
See application file for complete search history.

(56) References Cited

U.S. PATENT DOCUMENTS

| | | | | |
|---|---|---|---|---|
| 4,505,604 | A | 3/1985 | Takemoto | |
| 4,530,280 | A | 7/1985 | Kaneko et al. | |
| 4,569,607 | A | 2/1986 | Takemoto | |
| 4,619,536 | A | 10/1986 | Takemoto | |
| 4,708,501 | A | 11/1987 | Takemoto | |
| 6,267,469 | B1 * | 7/2001 | Silverbrook | 347/54 |
| 6,367,914 | B1 | 4/2002 | Ohtaka et al. | |
| 6,874,867 | B2 * | 4/2005 | DeBar et al. | 347/54 |
| 2007/0002122 | A1 | 1/2007 | Murano et al. | |
| 2007/0160383 | A1 | 7/2007 | Matsumoto et al. | |

FOREIGN PATENT DOCUMENTS

| | | |
|---|---|---|
| JP | 2827544 | 9/1998 |
| JP | 2001-63047 | 3/2001 |
| JP | 2001-105590 | 4/2001 |
| JP | 2001-277502 | 10/2001 |
| JP | 2002-359981 | 12/2002 |
| JP | 2004-160650 | 6/2004 |
| JP | 2006-297688 | 11/2006 |

OTHER PUBLICATIONS

U.S. Appl. No. 06/333,790, filed Dec. 23, 1981 (Claims & Drawings).

U.S. Appl. No. 06/654,259, filed: Sep. 25, 1984 (Claims & Drawings).

* cited by examiner

*Primary Examiner* — Juanita D Stephens

(74) *Attorney, Agent, or Firm* — Cooper & Dunham LLP

(57) ABSTRACT

A liquid ejection head includes a nozzle plate having a nozzle that ejects liquid drops, an actuator that deforms a portion of the nozzle plate surrounding the nozzle with heat, and a flow path member opposing the nozzle plate, which forms a flow path for guiding liquid to the nozzle. A fluidity resistance path is provided in the flow path between a nozzle plate portion surrounding the nozzle and a portion of the flow path member opposing the nozzle plate portion. A fluidity resistance of the fluidity resistance path is changed by deforming the nozzle plate portion.

7 Claims, 10 Drawing Sheets

LIQUID EJECTION HEAD WITH NOZZLE PLATE DEFORMED BY HEAT AND IMAGE FORMING APPARATUS INCLUDING THE LIQUID ELECTION HEAD

CROSS REFERENCE TO RELATED APPLICATION

This application claims priority under 35 USC §119 to Japanese Patent Application No. 2007-160858, filed on Jun. 19, 2007, and Japanese Patent Application No. 2008-105277, filed on Apr. 15, 2008, the entire contents of which are incorporated by reference.

BACKGROUND

1. Technical Field

This disclosure relates to a liquid ejection head and an image forming apparatus, and in particular to a liquid ejection head ejecting liquid drops and an image forming apparatus employing the liquid ejection head.

2. Discussion of the Background Art

An image forming apparatus, such a printer, a facsimile, a copier, a complex machine configured by combining these devices, etc., sometimes employs a liquid ejection device that includes a printing head having a liquid ejection head for ejecting and adhering liquid drops onto a medium, such as a paper, a string, a texture, a towel, a leather, a metal, a plastic, a glass, woods, ceramics, etc., while conveying the printing sheet to form an image.

The image formation includes not only a meaningful image, such as a character, a figure, etc., but also a meaningless image, such as a pattern, etc. The liquid is not limited to printing liquid or ink, but includes every type of liquid as far it is capable of executing image formation. The liquid ejection device generally ejects liquid from a liquid ejection head.

As one example of such a liquid ejection head employed in an image forming includes a heater in a nozzle plate to eject liquid drops from the nozzle while deforming the nozzle plate using a difference in heat expansion has been known as discussed in Japanese Patent Application Laid Open No. 2001-105590.

Various types of a liquid ejection head that deforms a nozzle plate including a flexible film by heat are described in the Japanese Patent Application Laid Open Nos. 2002-359981 and 2004-160650 as well as the Japanese Patent Registration No. 2827544.

There is a type that changes a fluidity resistance by connecting a vibration plate and a piezoelectric element to a bottom of the fluidity resistance flow path communicated with one end of the pressurizing chamber as described in the Japanese Patent Application Laid Open No. 2001-063047.

Since a liquid ejection head generally ejects liquid drops from a nozzle by pressurizing a liquid chamber or a flow path, pressure preferably does not leak from the liquid chamber when the pressure in the liquid chamber is to be efficiently increased and is applied to the liquid drops to be ejected. Thus, a liquid resistance section is arranged in the flow path that supplies liquid to the liquid chamber. In this point of view, the Japanese Patent Application Laid Open No. 2001-063047 employs a device capable of increasing the fluidity resistance when liquid drops are ejected.

However, these prior arts are still insufficient.

BRIEF SUMMARY

In an aspect of this disclosure, there is provided a liquid ejection head that includes a nozzle plate having a nozzle for ejecting liquid drops, an actuator for deforming a nozzle plate portion surrounding the nozzle, and a flow path member opposing the nozzle plate and forming a flow path for guiding liquid to the nozzle.

In another aspect, a fluidity resistance path is formed in the flow path between the nozzle plate portion and a portion of the flow path member opposing the nozzle plate portion. A fluidity resistance of the fluidity resistance path is changed by deforming the nozzle plate portion.

In another aspect, the flow path member includes at least one convex opposing either the nozzle or the nozzle plate portion in the fluidity resistance path.

In yet another aspect, the flow path member includes an inlet opposing the nozzle across the convex and configured to take in the liquid to the flow path.

In yet another aspect, the flow path member includes at least one concave opposing the nozzle plate portion in the fluidity resistance path.

In yet another aspect, the liquid ejection head includes a nozzle plate having a nozzle that ejects liquid drops, a deformable member including a wall opposing the nozzle, which guides liquid to the nozzle, and an actuator that deforms the deformable member. A holding member opposing the nozzle via the deformable member is provided to form a flow path guiding the liquid to the nozzle. A fluidity resistance path is formed in the flow path between a nozzle plate portion surrounding the nozzle and a surface of the deformable member opposing the nozzle plate portion. A fluidity resistance of the fluidity resistance path is changed by deforming the deformable member.

BRIEF DESCRIPTION OF DRAWINGS

A more complete appreciation of the aforementioned and other aspects, features and advantages will be readily obtained as the same becomes better understood by reference to the following detailed description when considered in connection with the accompanying drawings, wherein.

PREFERRED EMBODIMENTS OF THE PRESENT INVENTION

Figure 1:
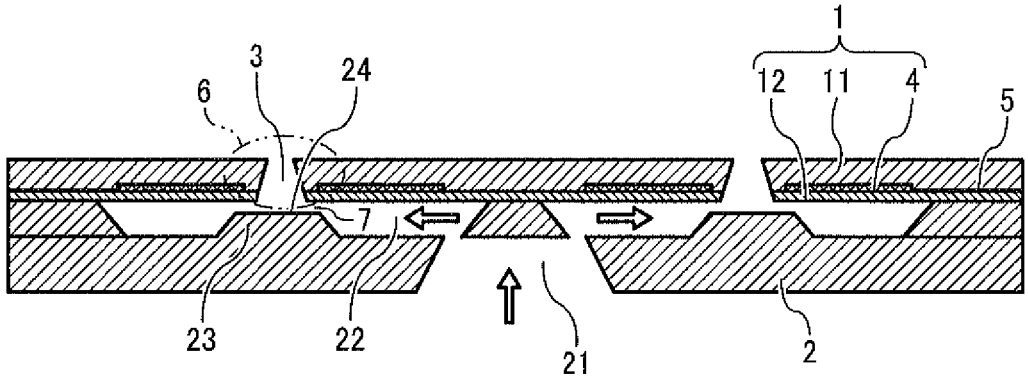
FIG. 1 is a cross sectional view illustrating an exemplary liquid ejection head according to a first embodiment of the present invention.
Figure 2:
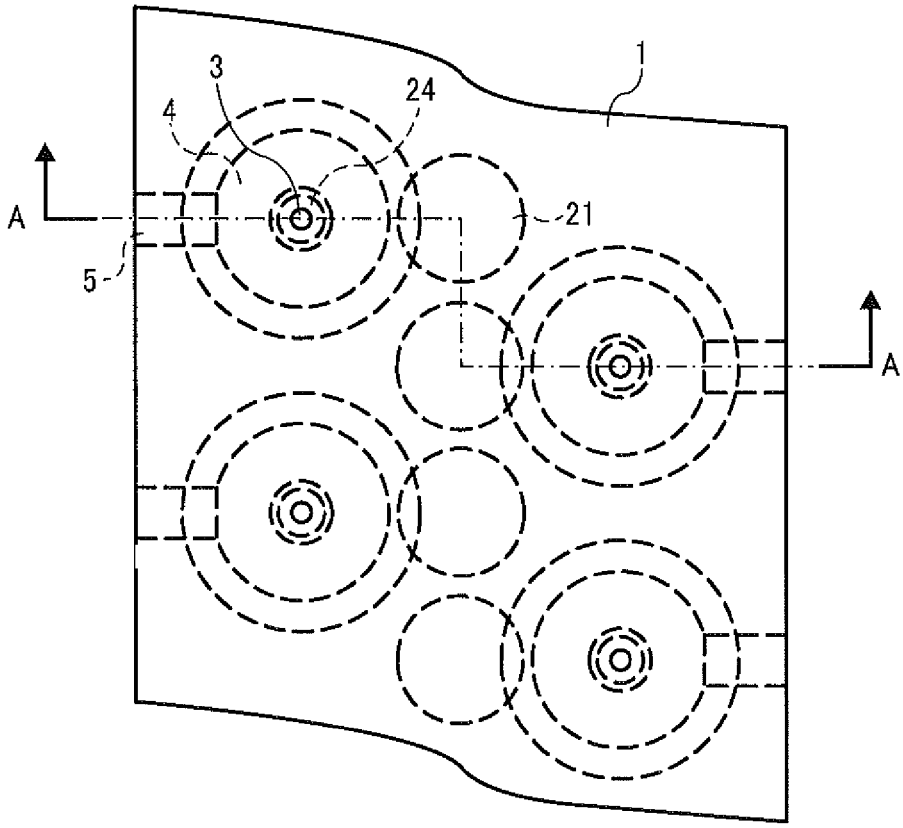
FIG. 2 is a plan view schematically illustrating the exemplary liquid ejection head of FIG. 1.
Figure 3:
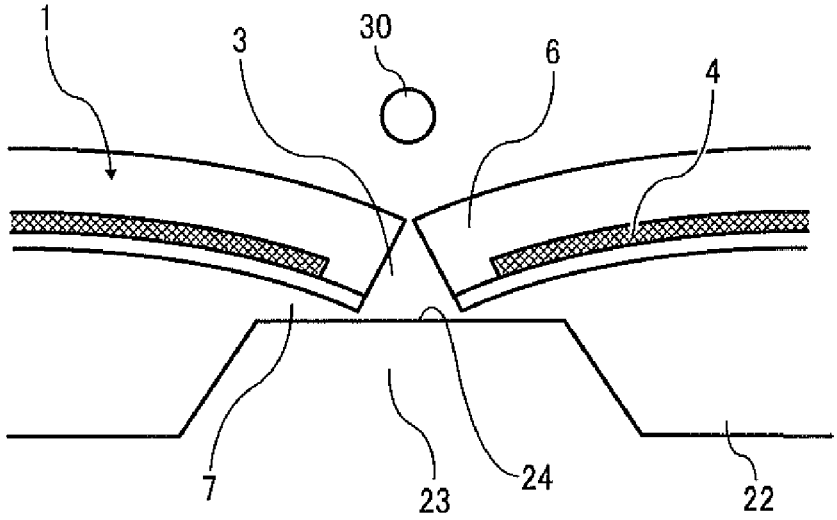
FIG. 3 is a cross sectional view illustrating an exemplary operation of the liquid ejection head of FIG. 1.

Referring now to the drawing, wherein like reference numerals designate identical or corresponding parts throughout several views, in particular, in FIGS. 1 and 2, an exemplary liquid ejection head according to the present invention is described. As shown, the liquid ejection head is formed by connecting a nozzle plate 1 to a flow path member 2 (e.g. a flow path substrate) 2.

A nozzle 3 is formed on the nozzle plate 1 to eject liquid drops. The nozzle plate 1 includes three layers. Specifically, an upper layer 11 is made of material having a large thermal expansion coefficient, such as Ni—Cr of 16×10E-6/° C. An inner layer 12 is made of material having a small thermal expansion coefficient, such as Cr of 8×10E-6/° C. A heater layer 4 is provided as an intermediate layer 4 between the layers 11 and 12 to serve as an actuator device. The intermediate layer 4 has a circular planner shape and surrounds the nozzle 3. The intermediate layer forms a bimetallic structure. Thus, an electrode 5 is connected to the heater layer 4 so as to supply power.

The flow path member 2 includes an ink supply inlet 21 and an ink supply path 22. The flow path member 2 includes a convex part 23 opposing the nozzle 3 and a surrounding area 6 of the nozzle 3 (herein after referred to as a nozzle surrounding section 6). Between a surface 24 of the convex part 23 and the nozzle surrounding section 6, a fluidity resistance path 7 having a larger fluidity resistance than that of the ink supply path 22 or another flowpath section of the ink supply inlet 21 are formed.

As shown by a void arrow in FIG. 1, liquid (ink) is supplied from the ink supply inlet 21 to the fluidity resistance path 7 via the image supply path 22 in such a liquid ejection head, thereby the nozzle 3 is fulfilled with the ink. In this state, by turning on the heat layer 4, the nozzle plate 1 having the above-mentioned bimetallic structure is heated up due to heat generation of the heat layer 4. Thus, the nozzle surrounding section 6 of the nozzle plate 1 is bent and deforms toward the opposing surface 24. Accordingly, the ink in the nozzle 3 receives pressure and is ejected from the nozzle 3.

At this moment, owing to approach of the nozzle surrounding section 6 toward the opposing surface 24, a cross sectional area of the opening of the fluidity resistance path 7 decreases, and the resistance value of the liquid in the fluidity resistance path 7 increases. As a result, an amount of the ink flowing from the nozzle 3 to the ink supply path 22 decreases.

Thus, pressure caused at the nozzle 3 is hardly conveyed to the image supply path 22, and is dedicatedly used as energy for ejecting the ink. As a result, ejection efficiency is significantly improved while low voltage drive can be obtained saving the power.

Thus, a fluidity resistance is changed by a simple construction and thereby capable of efficiently ejecting dink drops.

Figure 4:
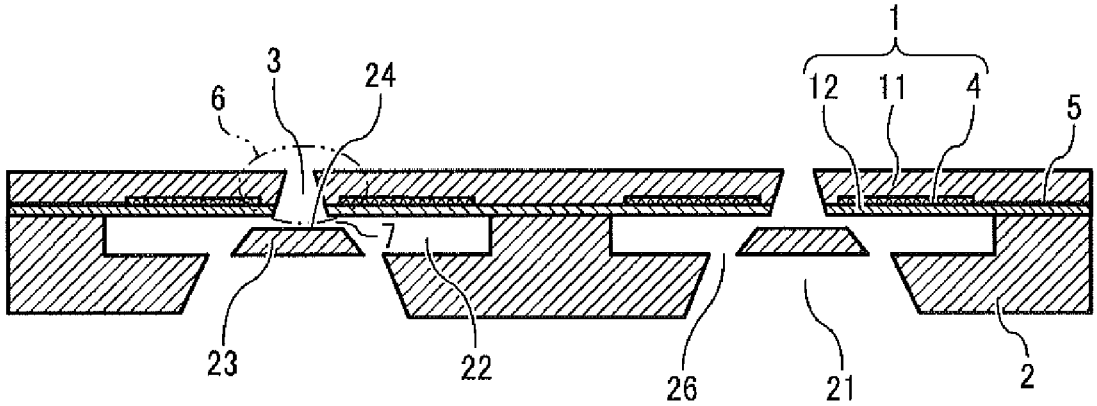
FIG. 4 is a cross sectional view illustrating an exemplary liquid ejection head according to a modification of the first embodiment of the present invention.
Figure 5:
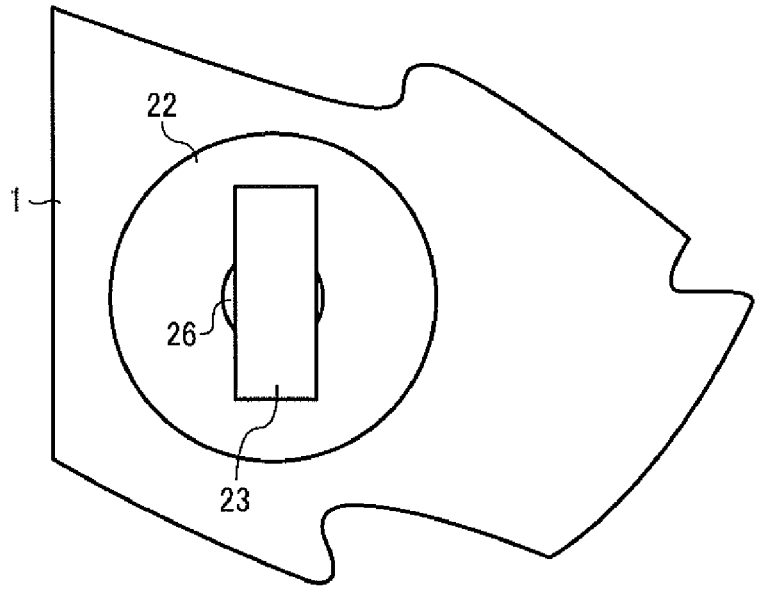
FIG. 5 is a plan view schematically illustrating the exemplary liquid ejection head of FIG. 4.

Now, a modification of the first embodiment of the liquid ejection head is described with reference to FIGS. 4 and 5. As shown, the ink supply inlet 21 is arranged opposing the nozzle 3 over the convex part 23, and supplies ink to the fluidity resistance path 7 from the ink path 26. Thus, a lateral width of the liquid ejection head becomes smaller, and thereby the cost is reduced.

Figure 6:
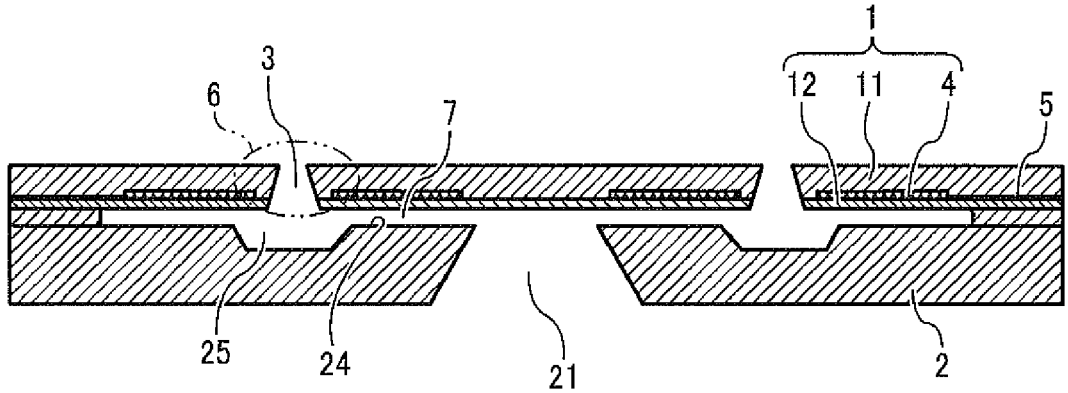
FIG. 6 is a cross sectional view illustrating an exemplary liquid ejection head according to a second embodiment of the present invention.

Now, a second embodiment of the liquid ejection head is described with reference to FIG. 6. As shown, the fluidity resistance path 7 is formed between the nozzle surrounding section 6 and the opposing surface 24. A concave part 25 is formed at a section of the opposing surface 24 to serve as an ink pool. Thus, a capacity of ink increases in the section, and thereby fixation of ink in the nozzle 3 due to ink drying can be suppressed.

Now, a driving operation of the liquid ejection head is described. As mentioned above, the liquid ejection head ejects ink by turning on the heater layer 4 while deforming the nozzle surrounding section 6. At that moment, by ejecting liquid drops while disengaging the nozzle surrounding section 6 with the opposing surface 24, a deformation amount of the nozzle plate 1 (i.e., the nozzle surrounding section 6) and accordingly a size of the ink drop can be changed in accordance with an amount of electricity supplied to the heater layer 4. As a result, a multi bit and high quality image having an excellent gray scalability can be printed.

By ejecting the liquid drops while engaging the nozzle surrounding section 6 with the opposing surface 24, the liquid drops can be constantly ejected and a high quality image can be obtained. Because, the amount of deformation of the nozzle surrounding section 6 is substantially constant.

Further, prescribed power is initially supplied to the heater layer 4 to change a size of the fluidity resistance path 7 to have a prescribed fluidity resistance not to eject ink drops, and then larger power can be supplied to eject the ink drops. Thus, a high quality image having an excellent gray scalability can be obtained, because a size of the liquid drops can be previously changed.

Figure 7:
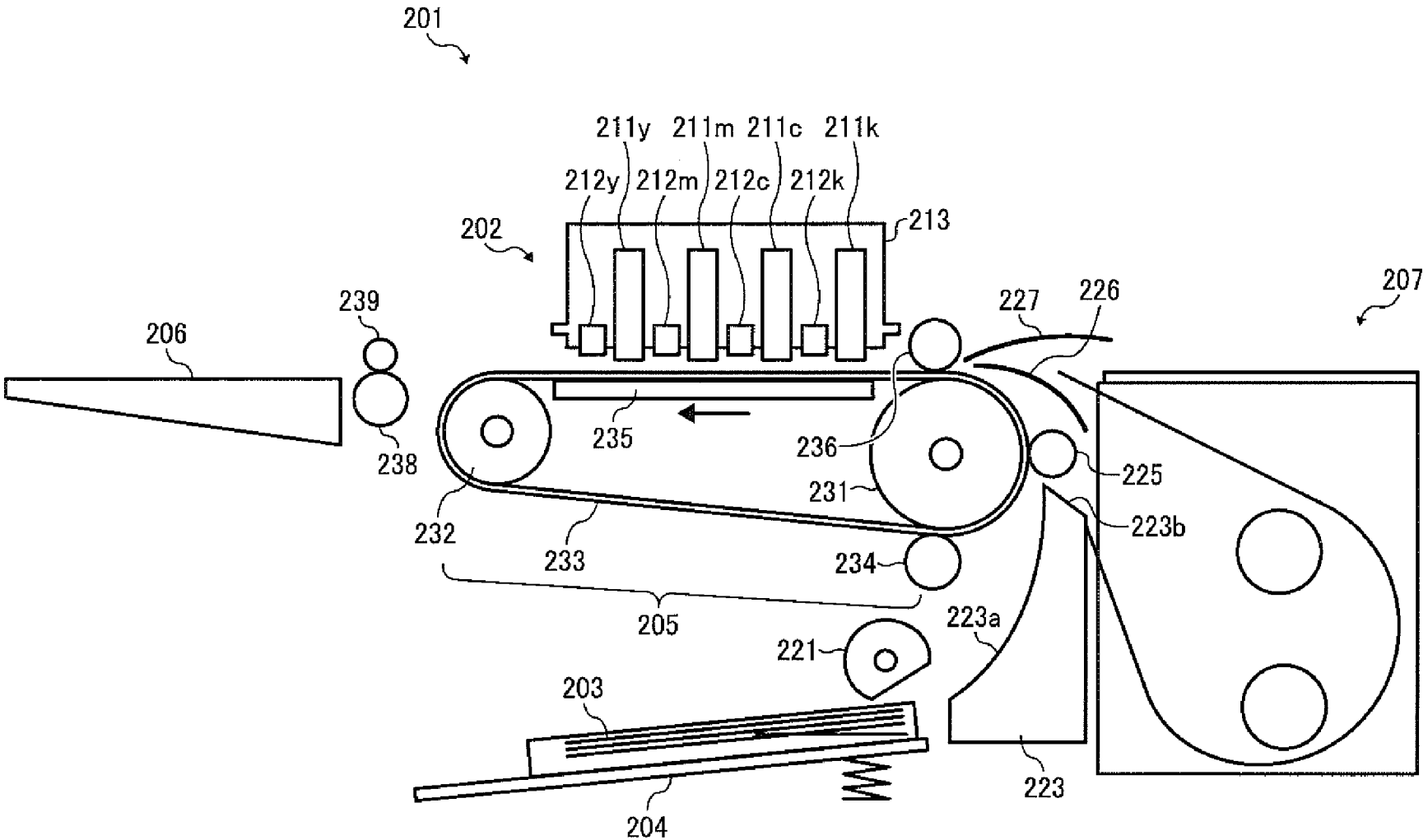
FIG. 7 schematically illustrates an exemplary image forming apparatus according to the present invention.

Now, an exemplary image forming apparatus including a liquid ejection head is described with reference to FIG. 7. The image forming apparatus includes an image formation section 202 in an apparatus body 201. A sheet-feeding tray 204 capable of stacking a plurality of printing sheets 203 is arranged at a lower section of the apparatus body 201. One of the printing sheets 203 fed from the sheet feeding tray 204 is taken in and receives printing of a prescribed image at the image formation section 202 while being conveyed by a conveyance mechanism 205. Then, the printing sheet 203 is ejected onto a sheet ejection tray 206 attached to a side of the apparatus body 201.

When a duplex unit 207 is attached to the apparatus body to execute duplex printing, the printing sheet 203 is reversely conveyed after one side printing is completed by the conveyance mechanism 205 and is taken in by the duplex unit 207. Then, the printing sheet is reversed to enable the other side to get ready to receive printing and is further launched into the conveyance mechanism 205 again. The printing sheet 203 is then ejected onto the printing sheet ejection tray 206 after the other side receives the printing.

The image formation section 202 includes four printing heads 211*k* to 211*y* of a full-line type for ejecting ink of black, cyan, magenta, and yellow mono-colors (K, C, M, and Y), respectively. Herein after, the four printing heads 211*k* to 211*y* are referred to as printing heads 211 when mono-color does not matter. Each of the printing heads 211 is attached with its nozzle surface facing downward, which forms a nozzle for ejecting liquid drops.

Four maintenance recovery mechanisms 212*k* to 212*y* are provided corresponding to the respective printing heads 211. Herein after, the four maintenance recovery mechanisms 212*k* to 212*y* are referred to as a maintenance recovery mechanism 212 when mono-color does not matter. When a performance maintenance operation, such as a purge process, a wiping process, etc., is executed, the printing head 211 and the maintenance recovery mechanism 212 are relatively moved so that four capping members serving as the maintenance recovery mechanism 212 can oppose the nozzle surface of the printing head 211.

As mentioned heretofore, the printing heads 211 are arranged to eject yellow to black colors in turn from the upstream side in the sheet conveyance direction. However, arrangement and number of colors are not limited thereto. One or more number of line type heads each including a plurality of nozzle lines can be employed for ejecting liquid drops of respective colors. An ink cartridge for supplying the head with ink can be integral with or separate from the head. Further, a line head can be formed by arranging straight lines of heads displaced from each other.

The printing sheets 203 in the sheet feeding tray 204 are separated by a separation pad, not shown, in cooperation with a sheet feeding roller 221 having a half moon shape one by one, and are is launched into the apparatus body 201. The printing sheet 203 is transferred into a gap between the registration roller 225 and the conveyance belt 233 along a guide surface 223*a* of the conveyance guide member 223. Then, the printing sheet 203 is transferred onto the conveyance belt 233 of the conveyance mechanism 205 via the guide member 226 at a prescribed time.

On the conveyance guide member 223, a guide surface 223*b* is formed so as to guide a printing sheet 203 launched from the duplex unit 207. Further arranged therein is a guide member 227 to guide the printing sheet 203 returned from a conveyance mechanism 205 to the duplex unit 207 when a duplex printing is executed.

The conveyance mechanism 205 includes an endless conveyance belt 233 wound around a conveyance roller 231 as a driving roller and a driven roller 232, a discharge roller 234 for discharging the conveyance belt 233, and a platen member 235 for maintaining the conveyance belt 233 to be flat at a section opposing the image formation section 235. Also included are a pressure applying roller 236 for depressing the printing sheet 203 toward the conveyance belt 233 and the conveyance roller 231, and a cleaning roller made of spongy member for removing printing liquid, such as ink adhering to the conveyance belt 233 or the like.

On the downstream side of the conveyance mechanism 205, an ejection roller 238 and a spur 239 are provided to launch a printing sheet 203 with an image onto the ejection tray 206.

In such an image forming apparatus, the conveyance belt 233 travels and circulates in a direction as shown by an arrow, and is charged by contacting the discharge roller 334 in a positive polarity, because a voltage of a high potential is applied to the discharge roller 334. Specifically, the discharge roller 234 with a charge voltage discharges the conveyance belt 233 at a prescribed interval while a polarity thereof is switched at the prescribed interval.

When a printing sheet 203 is fed onto the conveyance belt 233 with the charge of the high potential, the inside of the printing sheet 203 becomes a polarity-separated condition. Thus, electrode having a reverse polarity to that on the conveyance belt 233 is induced on the surface of the printing sheet 203 contacting the conveyance belt 233, and the electrode on the conveyance belt 233 and that on the printing sheet 203 electro-statically pull each other. Thus, the printing sheet 203 is electro-statically attracted to the conveyance belt 233. As a result, bent and concavity and convexity on the printing sheet are corrected when the printing sheet is intensely attracted to the conveyance belt 233, thereby highly flat surface can be formed.

By circulating the conveyance belt 233 and thereby conveying the printing sheet 203 while ejecting liquid drops from the printing head 21, a prescribed printing image is formed on the printing sheet 203. Then, the printing sheet 203 with the printing image is ejected onto the sheet ejection tray 206 by the sheet ejection roller 238.

As a result, an image can be formed at high speed highly improving efficiency of ejecting liquid drops.

Figure 8:
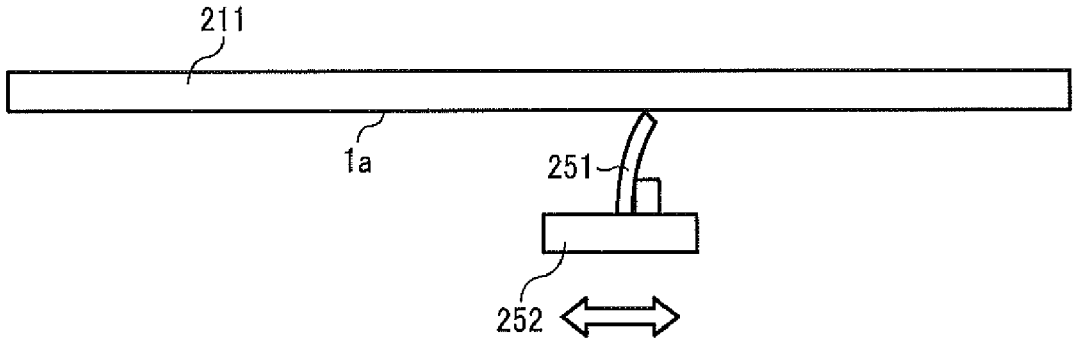
FIG. 8 illustrates an exemplary wiping operation executed in the image forming apparatus of FIG. 7.

Now, an exemplary maintenance recovery operation for a printing head of the image forming apparatus is described with reference to FIG. 8. A wiping member 251 is provided on a scanning member 252 as a maintenance recovery mechanism 212 for wiping the surface 1*a* of the nozzle of the printing head 211. When a wiping operation is executed, prescribed power is supplied to the heater layer of the printing head 211 not to eject liquid drops and temperature of the surface of the nozzle plate 1 increases. Then, the nozzle surface 1*a* of the printing head 211 is wiped by moving and scanning the wiping member 251.

Since the temperature of the nozzle plate surface (i.e. the ejection side surface) increases due to the power supply to the heater serving as an actuator, adhesion ink and plastic are soften, and thereby sticking force decreases. Accordingly, the nozzle plate surface can be easily cleaned by means of the wiping member. As a result, a bias to the wiping member can be decreased, and accordingly, a waterproof layer applied to the nozzle surface or the like hardly wears, thereby a durability of the head is improved. Further, ink can be replenished while preliminary applying prescribed heat to the nozzle plate not to eject drops, similarly.

Figure 9:
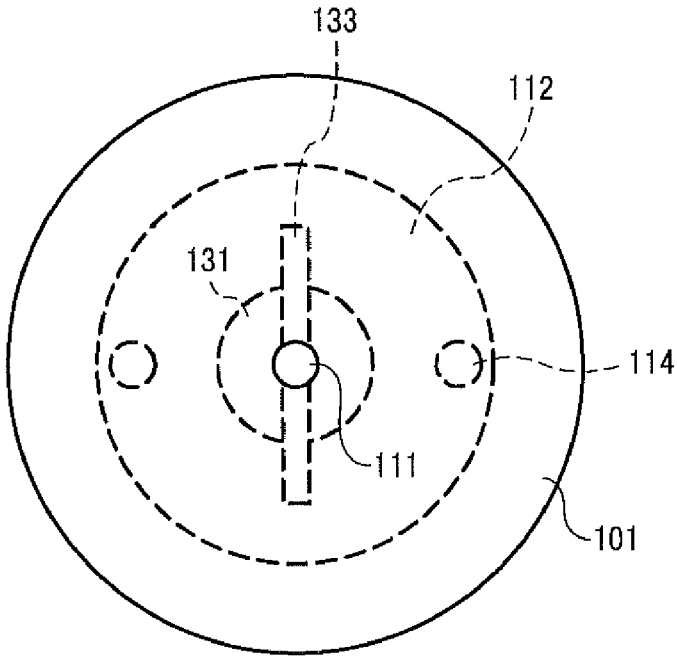
FIG. 9 is a plan view schematically illustrating an exemplary liquid ejection head according to a third embodiment of the present invention.
Figure 10:
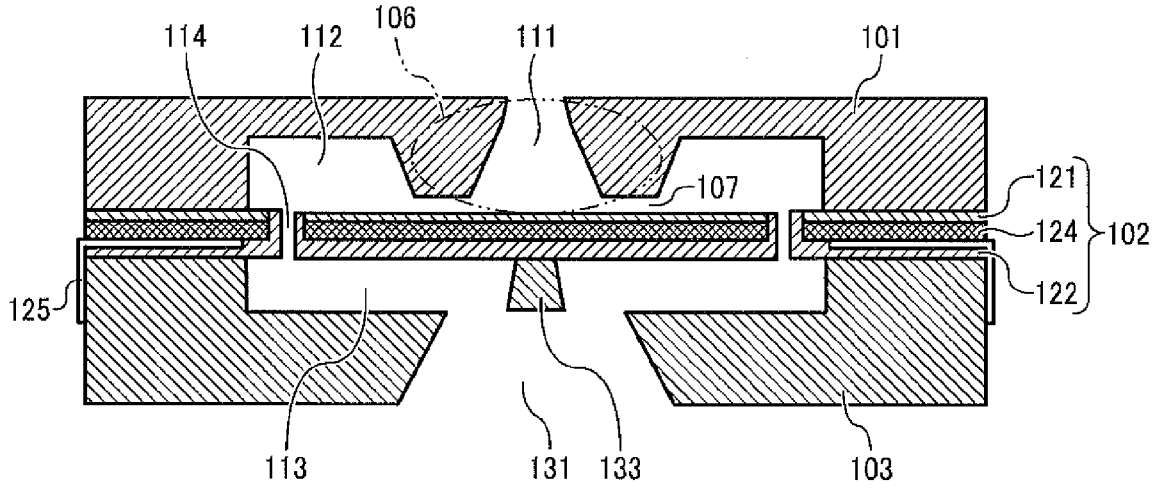
FIG. 10 is a cross sectional view schematically illustrating the liquid ejection head of FIG. 9.

Now, another exemplary liquid ejection head of a third embodiment according to the present invention is described with reference to FIGS. 9 and 10. The liquid ejection head includes a nozzle plate 101 including a nozzle 111 for ejecting liquid drops, a vibration plate 102 serving as a displace member arranged opposing the nozzle plate 101 so as to form a wall of a flow path 112, which guides the liquid drops to the nozzle 111, a heater layer 124 serving as an actuator for bending and deforming the vibration plate 102 with heat, and a holding member 103 arranged opposing the nozzle plate 101 over the vibration plate 102 to form a flow path 113, which guides the liquid to the surface of the vibration plate opposite to the nozzle plate 101. Further, a fluidity resistance path 107 having a larger fluidity resistance than the flow path 112 is formed between the surrounding section on the nozzle 111 of the nozzle plate 101 and a section of the vibration plate 102 opposing the surrounding section 106.

The vibration plate 102 includes a three-layer construction similar to the above-mentioned nozzle plate 1. Specifically, a layer 121 made of material having a relatively low thermal expansion coefficient is arranged on the side of the nozzle 101. A layer 122 made of material having a relatively high thermal expansion coefficient is arranged opposing the nozzle 101. And, a heater layer 124 serving as an actuator is arranged between the layers 121 and 122. Thus, a bimetallic construction is formed. An electrode 125 is connected to the heater layer 124.

In the holding member 103, an ink supply inlet 131 and a flow path 113 are formed. In the flow path member 103, a limit section 133 is provided to limit a deformation of the vibration plate 102 opposing the nozzle 111. Further, in the vibration plate 102, a passage 114 connecting the flow paths 112 and 113 to each other are arranged.

In the liquid ejection head with such a construction, liquid (e.g. ink) is supplied from the ink supply inlet 131 to the fluidity resistance path 107 via the flow paths 113 and 112, and the passage 114. Thus, the nozzle 111 is fulfilled with the ink. Then, by supplying power to the heater layer 124 and causing the heat layer 124 to generate heat, the vibration plate 102 is heated. Thus, a central section of the vibration plate 102 deforms toward the nozzle 111 and ink within the nozzle 111 is pressurized, thereby liquid drops are ejected from the nozzle 111.

Due to bending of the vibration plate 102 toward the nozzle surrounding section 106, an area of the opening of the fluidity resistance path 107 decreases while a fluidity resistance of the fluidity resistance path 107 increases. Thus, an amount of the ink flowing from the nozzle 111 to the flow path 112 is reduced. Accordingly, since pressure caused by deformation of the vibration plate member is almost spent as ink ejection energy, ejection efficiency is significantly improved. Further, low voltage driving is achieved while suppressing consumption of the power.

Since the vibration plate 102 including the heater layer 124 as an actuator device is arranged in the liquid, heat transmission from the heater layer 124 is hardly accumulated in the holding member 103 and the nozzle plate 101. As a result, driving can be steady and continuous.

Figure 11:
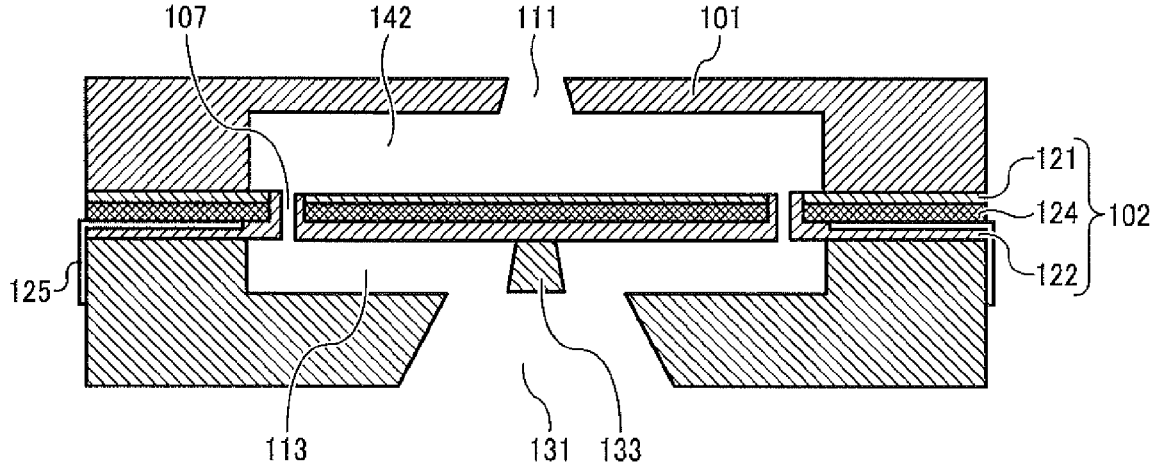
FIG. 11 is a cross sectional view schematically illustrating an exemplary liquid ejection head according to a fourth embodiment of the present invention.

Now, an exemplary liquid ejection head of a fourth embodiment is described with reference to FIG. 11. A liquid ejection head has a similar configuration to that in the third embodiment. However, a liquid chamber 142 facing to the nozzle 111 is formed by means of the nozzle plate 101 and the vibration plate 102 employing a passage 107 on the vibration plate 102 as a fluidity resistance section. Thus, by applying pressure to the ink in the liquid chamber 142 by means of deformation of the vibration plate 102 due to the heat, the liquid drops is ejected from the nozzle 111.

Also in this configuration, since the vibration plate 102 including the heater layer 124 is arranged in the ink as liquid, heat transmission from the heater layer 124 is hardly accumulated in the holding member 103 and the nozzle plate 101, thereby capable of steadily and continuously driving the liquid ejection head.

Any of the liquid ejection head described in these third and fourth embodiment can be built-in in an image forming apparatus.

Figure 12:
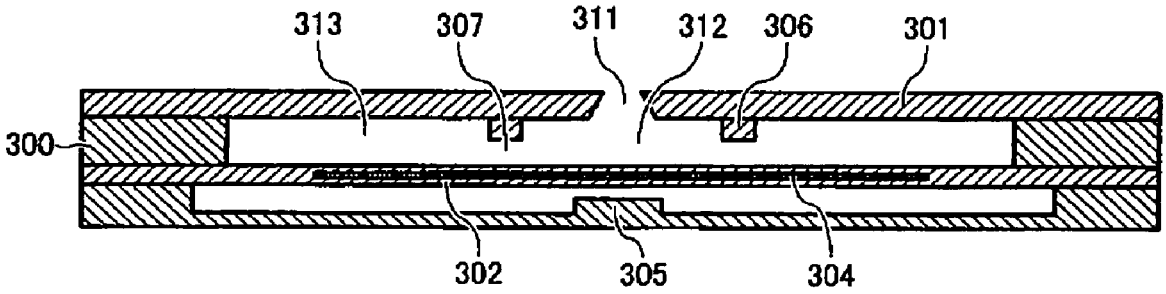
FIG. 12 is a cross sectional view schematically illustrating an exemplary liquid ejection head according to a fifth embodiment of the present invention.

Now, a fifth embodiment of an exemplary liquid ejection head according to the present invention is described with reference to FIG. 12. The liquid ejection head includes a fluid path member 300, a nozzle plate 301 having a nozzle 311 for ejecting liquid drops, a vibration plate member 302 that opposes the nozzle plate 301 and forms walls of a pressurizing chamber 312 communicated with the nozzle 311 and a fluidity path 313 for supplying liquid to the pressurizing chamber 312 as a displacing member, and a heat layer 304 serving as an actuator for bending and deforming the vibration plate member 302 with heart. The liquid ejection head also includes a stopper member 305 disposed opposing the nozzle plate 301 (or a pressuring chamber 312) via the vibration plate member 302 and is contacted by the vibration plate member 302 when the actuator device deformed the vibration plate member 302.

Further, a convex section 306 is formed on the nozzle plate 301 around the nozzle 311 and thereby forming the pressuring chamber 312. Between the convex section 306 and the portion of the vibration plate member 302 opposing the convex section 306, a fluidity resistance path 307 having larger fluidity resistance than the fluidity path 313 that communicated with the pressurizing chamber 312 is formed. A supply inlet, not shown, supplies liquid to the fluidity path 313.

Figure 13:
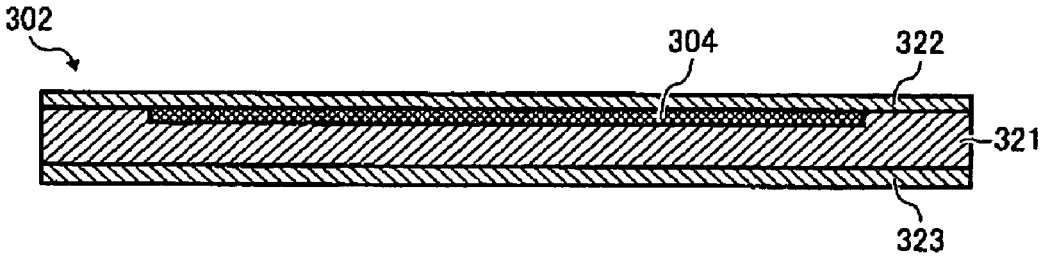
FIG. 13 is a cross sectional view illustrating one example of a vibration plate member included in the head of FIG. 12.

As shown in FIG. 13, the vibration plate member 302 includes a vibration plate layer 321 having a poly-silicone layer or the like, a heater layer 304, an insulation layer 322, an anti-ink layer 323 or the like and is initially bent on the side of the anti-ink layer 323. Since the periphery of the vibration plate member 302 is secured, the central section (i.e., a section opposing the nozzle 311) is bent toward the stopper member 305.

Figure 14A:
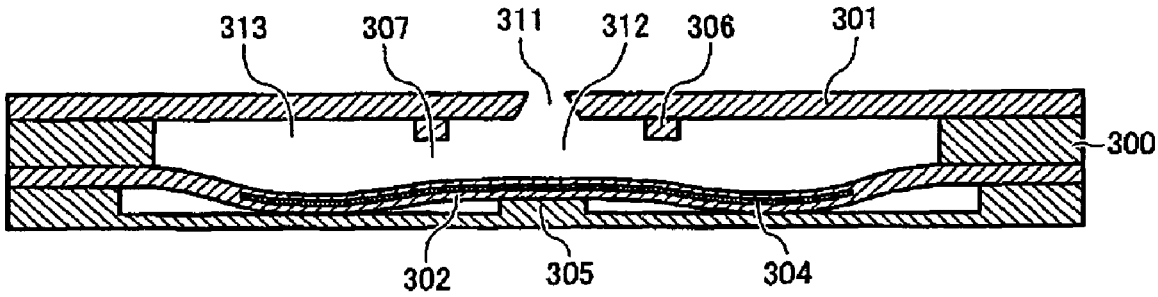
FIGS. 14A and 14B are cross sectional views collectively illustrating an exemplary operation of the head shown in FIG. 12.
Figure 14B:
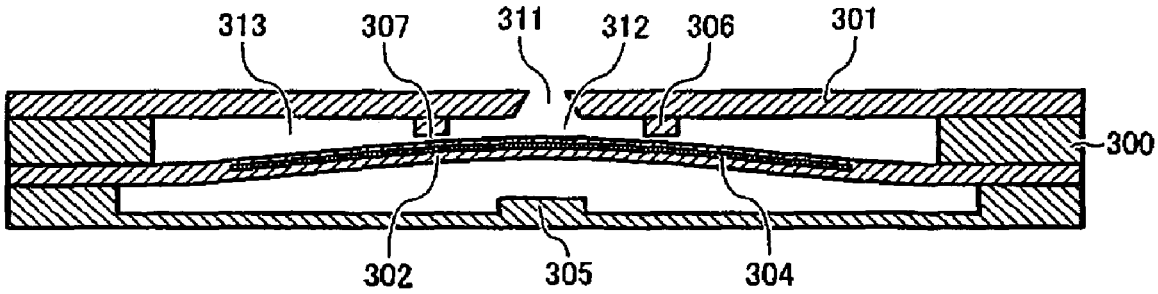

Since the vibration plate member 302 extends in parallel to its plane when the heater layer 304 is supplied with power, and the vibration plate member 302 is deformed and contacts the stopper member 305 as shown in FIG. 14A due to the initial bent toward the anti-ink layer 323. However, since the periphery is secured when the vibration plate member 302 extends, the vibration plate member 302 is deformed toward the nozzle 311 and pressurizes the liquid in the pressurizing chamber 312 as shown in FIG. 14B, thereby liquid drops are ejected from the nozzle 311.

At this moment, since the vibration plate member 302 is bent toward the convex section 306, a cross sectional area of the opening of the fluidity resistance path 307 decreases, and a fluidity resistance on the fluidity resistance path 307 increases, ink flowing into the pressurizing chamber 312 from the nozzle 311 decreases. As a result, the bending force is mainly used for ink ejection energy, and accordingly, ejection efficiency is significantly improved while saving a head driving voltage and power.

Figure 15A:
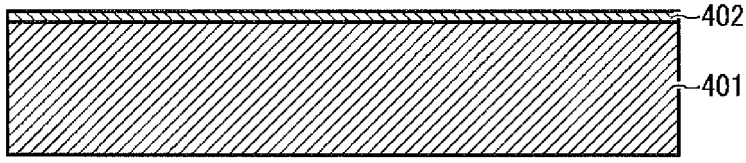
FIGS. 15A to 15E are cross sectional views collectively illustrating an exemplary manufacturing process for manufacturing the vibration plate member of FIG. 12.
Figure 15B:
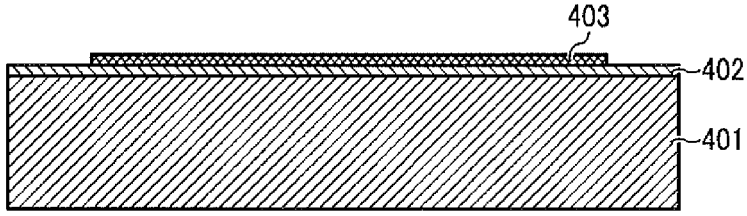
Figure 15C:
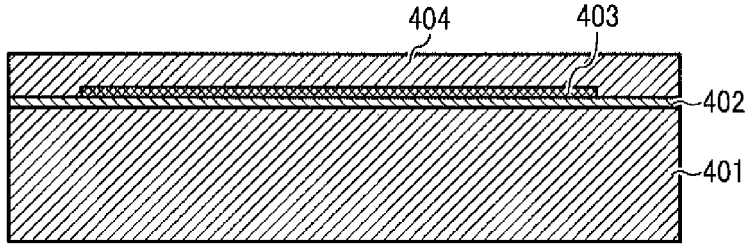
Figure 15D:
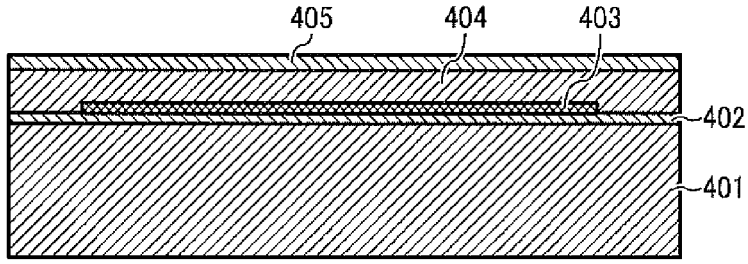
Figure 15E:
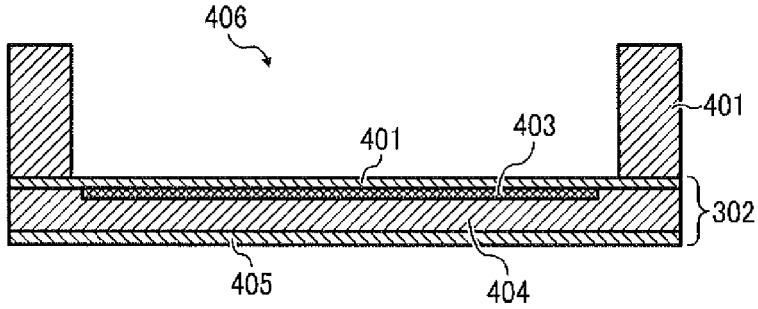

Now, one example of a manufacturing process for manufacturing the above-mentioned vibration plate member 302 is described with reference to FIGS. 15A to 15E. As shown in FIG. 15A, a silicone nitride film ($Si_3N_4$) 402 having a thickness of about 0.2 micrometer is initially coated onto a silicone substrate 401 using a LPCVD method. Then, as shown in FIG. 15B, a metal film (e.g. a heater layer) 403 having a thickness of about 0.2 micrometer is coated onto the silicone nitride film 402 using a spatter method. A patterning process is performed to create a prescribed shape using a lithography etching method. Then, as shown in FIG. 15C, a poly-silicone layer 404 having a thickness of about 0.5 micrometer is coated onto the metal film 403 using the LPCVD method. Then, as shown in FIG. 15D, a poly-silicone layer 405 having a thickness of about 0.2 micrometer is coated onto the poly-silicone layer 404 using the LPCVD method. Then, as shown in FIG. 15E, an etching process is applied to the silicone substrate 401, and a concave section 406 is formed to provide the pressurizing chamber 312 and the fluidity path 313. Since the silicon nitride film 402 and the metal film 403 serve as tension stress films, while the poly-silicone layer 404 and the silicone oxide film 405 serve as compression stress films, the vibration plate member 302 is bent as a whole on the side of the silicone oxide film 405.

Figure 16:
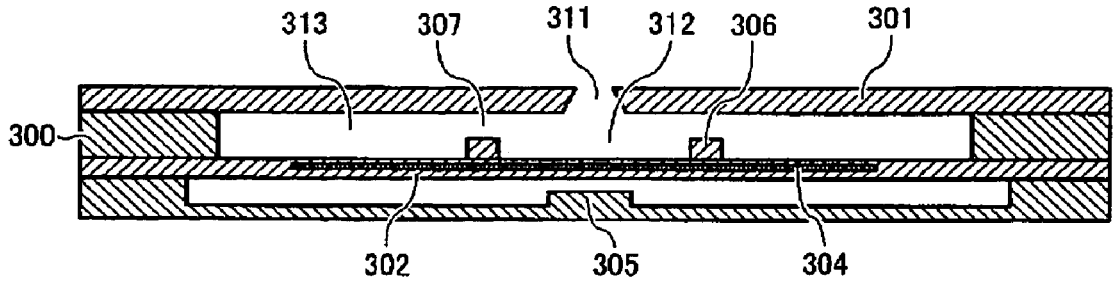
FIG. 16 is a cross sectional view schematically illustrating an exemplary liquid ejection head according to a sixth embodiment of the present invention.

Now, a sixth embodiment of an exemplary liquid ejection head is described with reference to FIG. 16. The difference from the liquid ejection head of the fifth embodiment is that a convex section 306 is provided on the side of the vibration plate member 302 to form a fluidity resistance path 307 having a larger fluidity resistance than the fluidity path 313 communicated with the pressurizing chamber 312 between the periphery section of the nozzle 311 and a surface of the vibration plate member 302 opposing the periphery section.

Figure 17:
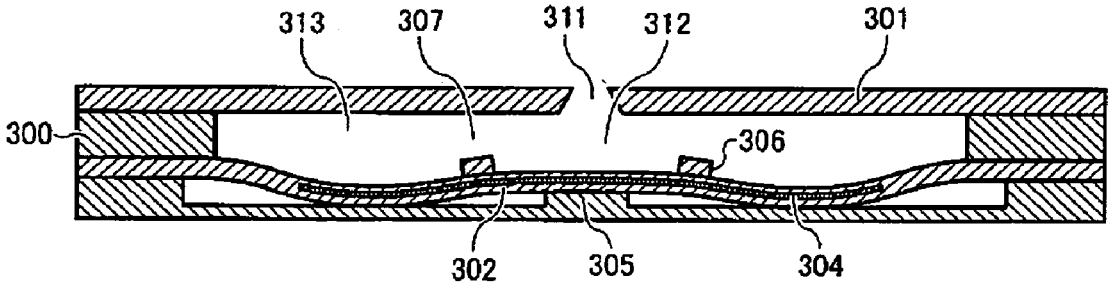
FIG. 17 is a cross sectional view illustrating an exemplary operation of the head shown in FIG. 16.

Specifically, the vibration plate member 302 is deformed as shown in FIG. 17, when the heater layer 304 is supplied with power.

Figure 18:
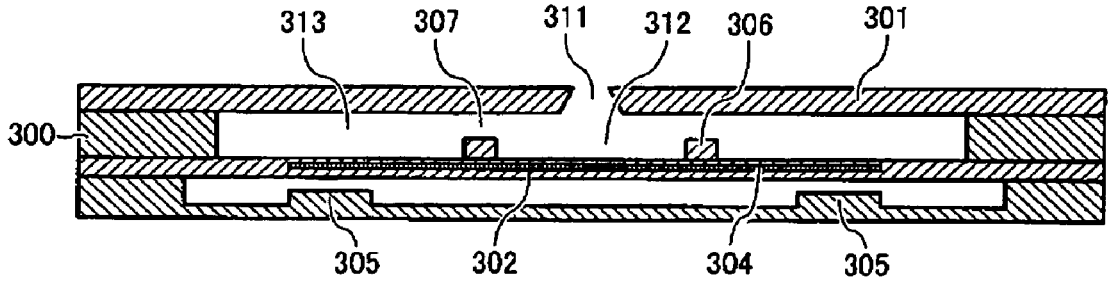
FIG. 18 is a cross sectional view schematically illustrating an exemplary liquid ejection head according to a seventh embodiment of the present invention.

Now, a seventh embodiment of an exemplary liquid ejection head is described with reference to FIG. 18. The difference from the sixth embodiment is that plural stoppers 305 are arranged between the central from the sixth embodiment and outer peripheral sections on the vibration plate 302. As similar to the fifth and sixth embodiments, the vibration plate member 302 is deformed on the side of the nozzle 311 after contacting the stoppers 305 and 306, thereby liquid drops is ejected.

The above-mentioned various embodiments of the present invention can be applied to a facsimile, a copier, a multifunction machine having functions of a printer, the facsimile and the copier beside the printer. Further, the invention is also applied to an image forming apparatus that ejects liquid other than the ink, such as resist, DNA sample used in a medical field, or the like. Numerous additional modifications and variations of the present invention are possible in light of the above teachings. It is therefore to be understood that within the scope of the appended claims, the present invention may be practiced otherwise that as specifically described herein.

What is claimed is:

1. A liquid ejection head comprising:

a nozzle plate including a nozzle configured to eject liquid drops;

an actuator configured to deform a nozzle plate portion of the nozzle plate with heat, said nozzle plate portion surrounding the nozzle;

a flow path member opposing the nozzle plate and configured to form a flow path, said flow path guiding liquid to the nozzle; and a fluidity resistance path formed in the flow path between the nozzle plate portion and a portion of the flow path member opposing the nozzle plate portion;

wherein a fluidity resistance of the fluidity resistance path is changed by deforming the nozzle plate portion, and wherein said flow path member includes at least one convex part opposing one of the nozzle and the nozzle plate portion in the fluidity resistance path.

2. The liquid ejection head as claimed in claim 1, wherein said flow path member includes an inlet opposing the nozzle via the convex and configured to take in the liquid to the flow path.

3. The liquid ejection head as claimed in claim 1, wherein the liquid is pressed and a liquid droplet is ejected when the actuator causes the nozzle plate portion to deform towards a surface of the convex part.

4. A liquid ejection head comprising;

a nozzle plate including a nozzle configured to eject liquid drops;

an actuator configured to deform a nozzle plate portion of the nozzle plate with heat, said nozzle plate portion surrounding the nozzle;

a flow path member opposing the nozzle plate and configured to form a flow path, said flow path guiding liquid to the nozzle; and a fluidity resistance path formed in the flow path between the nozzle plate portion and a portion of the flow path member opposing the nozzle plate portion;

wherein a fluidity resistance of the fluidity resistance path is changed by deforming the nozzle plate portion, and wherein said flow path member includes at least one concave part opposing the plate portion in the fluidity resistance path.

5. An image forming apparatus for forming an image by ejecting liquid drops from a liquid ejection head, said liquid ejection head including:

a nozzle plate including a nozzle configured to eject liquid drops;

an actuator configured to deform a nozzle plate portion of the nozzle plate with heat, said nozzle plate portion surrounding the nozzle;

a flow path member opposing the nozzle plate and configured to form a flow path, said flow path guiding liquid to the nozzle; and a fluidity resistance path formed in the flow path portion between the nozzle plate portion and a portion of the flow path member opposing the nozzle plate portion;

wherein a fluidity resistance of the fluidity resistance path is changed by deforming the plate portion, said flow path member includes (i) a convex part opposing one of the nozzle and the nozzle plate portion in the fluidity resistance path, or (ii) a concave part opposing the plate portion in the fluidity resistance path.

6. The image forming apparatus as claimed in claim 5, further comprising a wiper configured to wipe an ejection surface of the nozzle plate, wherein the actuator is turned on when the ejection surface is wiped.

7. The image forming apparatus as claimed in claim 5, wherein the liquid is pressed and a liquid droplet is ejected when the actuator causes the nozzle plate portion to deform towards a surface of the convex part.

* * * * *